US006954363B2

(12) United States Patent
Fan

(10) Patent No.: US 6,954,363 B2
(45) Date of Patent: Oct. 11, 2005

(54) ELECTRICAL CONNECTOR HAVING IMPROVED ELECTROSTATIC DISCHARGE PROTECTION

(75) Inventor: Chia Hao Fan, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/979,899

(22) Filed: Nov. 1, 2004

(65) Prior Publication Data

US 2005/0095914 A1 May 5, 2005

(30) Foreign Application Priority Data

Nov. 4, 2003 (TW) ..... 92219545 U

(51) Int. Cl.[7] ..... H06K 9/00

(52) U.S. Cl. ..... 361/816; 361/752; 361/818; 439/607

(58) Field of Search ..... 361/752–753, 361/816, 818; 439/101, 181, 567, 607, 608–610

(56) References Cited

U.S. PATENT DOCUMENTS 5,219,294 A 6/1993 Marsh et al.
5,256,074 A 10/1993 Tan et al.
5,356,300 A 10/1994 Costello et al.
5,567,168 A 10/1996 Marsh et al.
5,567,169 A 10/1996 McCleerey et al.
6,074,225 A * 6/2000 Wu et al. ..... 439/101
6,638,104 B2 * 10/2003 Hashimoto et al. ..... 439/567
6,755,691 B2 * 6/2004 Sasame et al. ..... 439/607

* cited by examiner

*Primary Examiner*—Kamand Cuneo
*Assistant Examiner*—Tuan Dinh
(74) *Attorney, Agent, or Firm*—Wei Te Chung

(57) ABSTRACT

An electrical connector (1) includes an insulative housing (2), a number of signal and power contacts (3, 4), a first and a second shell-halves (51, 52), and a grounding strip (6). The grounding strip includes a bar portion (60), a plurality of claws (61) and a pair of contacting portions (62). The insulative housing includes a shroud wall formed by a pair of longitudinal walls (22, 23) and defining a receiving cavity (200), and a tongue portion (21) extending into the receiving cavity. The tongue portion defines a plurality of passages (211, 212) to receive the contacts, a receiving groove (210) to receive the bar portion and a plurality of engaging grooves (213) located beside the receiving groove symmetrically and engagingly receiving the claws. Each shell-half includes a plate portion (50) enclosing the longitudinal wall and a side portion (511) vertically extending from the plate portion and enclosing the lateral wall. The contacting portions of the grounding strip electrically connect with the side portions of the shielding shell, respectively.

3 Claims, 4 Drawing Sheets

ELECTRICAL CONNECTOR HAVING IMPROVED ELECTROSTATIC DISCHARGE PROTECTION

BACKGROUND OF THE INVENTION

1. Field of the Invention

The present invention relates to an electrical connector, and particularly to an electrical connector having an additional grounding strip for achieving perfect ESD shielding protection. The invention relates to the copending applications titled "ELECTRICAL CONNECTOR" and "SHIELDED BOARD-MOUNTED ELECTRICAL CONNECTOR" having the same applicant and the same assignee with the instant invention.

2. Description of Related Art

Circuits to which contacts of electrical connectors are commoned are sensitive to or can be damaged by transient voltages such as electrostatic discharge. To prevent the electrostatic discharge (ESD) from conducting to the circuits, it is prevented from discharging to the contacts of the connector. To prevent electrostatic buildup on a device being electrically connected to the electrical connector from discharging to one or more contacts of the connector, an electrostatic discharge conductor is typically positioned forward of the leading edge of the contacts in the connector to be the location to which an electrostatic discharge is grounded.

U.S. Pat. Nos. 5,256,074, 5,219,294, 5,567,168 respectively disclose such an electrical connector. Each electrical connector disclosed in the patents mentioned above comprises a grounding strip or blade type conductive member received in a groove defined in the insulative body of the electrical connector. The grounding strip or blade type conductive member electrically connects with a conductive shell enclosing the insulative body, thus, the electrical connector gains an ESD protection. However, the grounding strip or blade type conductive member is inserted into the groove directly and the retaining force between the grounding strip or blade type conductive member and the insulative body is very tiny. Therefore, the grounding strip or blade type conductive member has a relatively big configuration and consumes relatively more material. Otherwise, the grounding strip or blade type conductive member has possibility of separating from the insulative body, and influencing the ESD effect of the electrical connector.

Hence, an electrical connector having improved ESD protection is desired.

SUMMARY OF THE INVENTION

An object of the present invention is to provide an electrical connector having improved grounding strip structure for achieving perfect ESD protection.

To achieve the above object, an electrical connector in accordance with the present invention comprises an insulative housing, a plurality of signal and power contacts, a conductive shielding shell and a grounding strip comprising a bar portion, a plurality of claws and a pair of contacting portions formed at opposite ends of the bar portion. The insulative housing comprises a shroud wall defining a receiving cavity therein and a tongue portion extending into the receiving cavity. The shroud wall comprises a pair of longitudinal walls and a pair of lateral walls. The tongue portion defines a plurality of passages in opposite sides thereof to receive the contacts, a receiving groove in a top surface thereof to receive the bar portion of the grounding strip and a plurality of engaging grooves located beside the receiving groove symmetrically and engagingly receiving the claws. The shielding shell comprises a first shell-half and a second shell-half. Each shell-half comprises a plate portion enclosing the longitudinal wall and a side portion vertically extending from the plate portion and enclosing the lateral wall. The contacting portions of the grounding strip electrically connect with the side portions of the shell-halves, respectively.

Other objects, advantages and novel features of the invention will become more apparent from the following detailed description when taken in conjunction with the accompanying drawings.

DETAILED DESCRIPTION OF THE INVENTION

Figure 1:
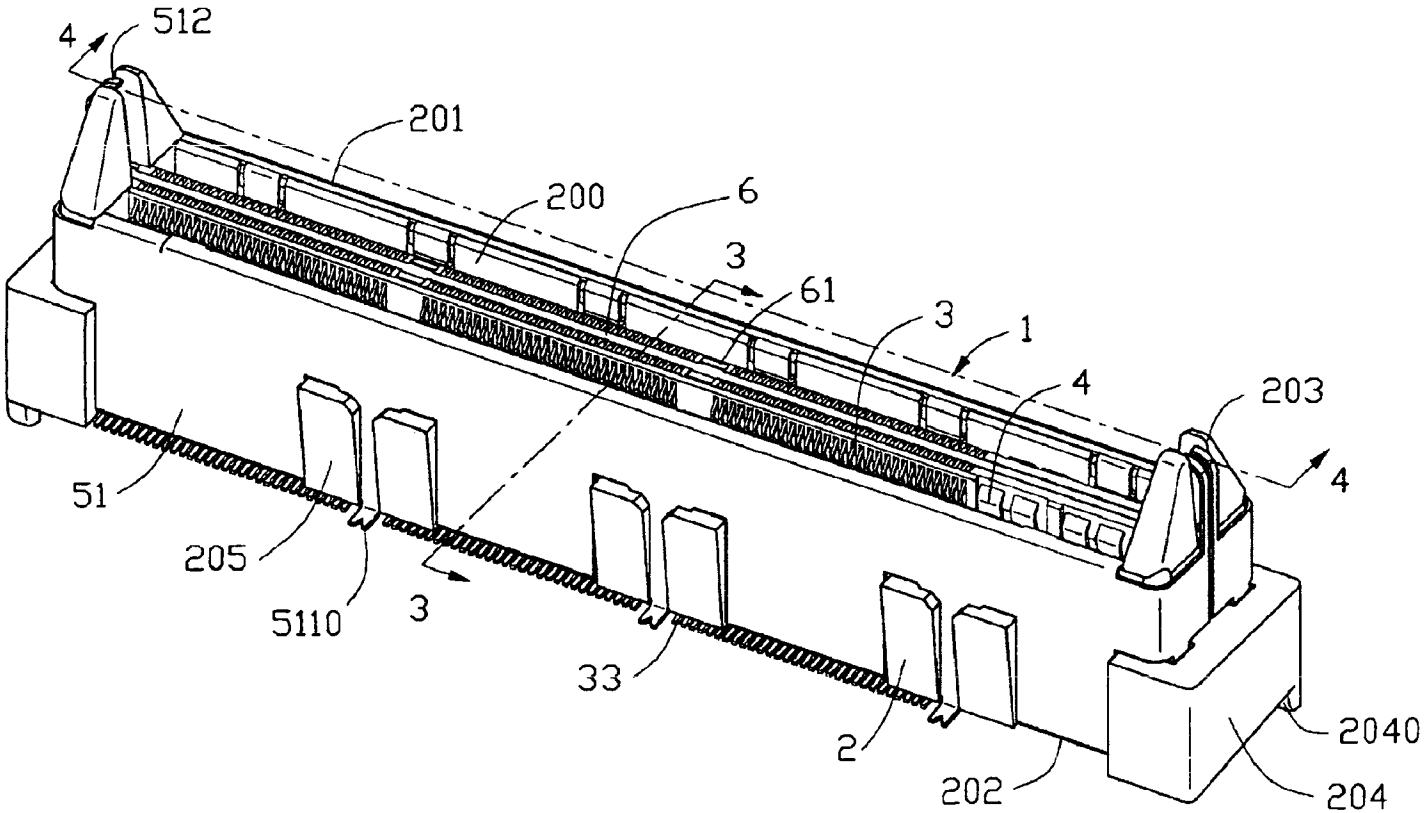
FIG. 1 is a perspective, assembled view of an electrical connector in accordance with the present invention.
Figure 2:
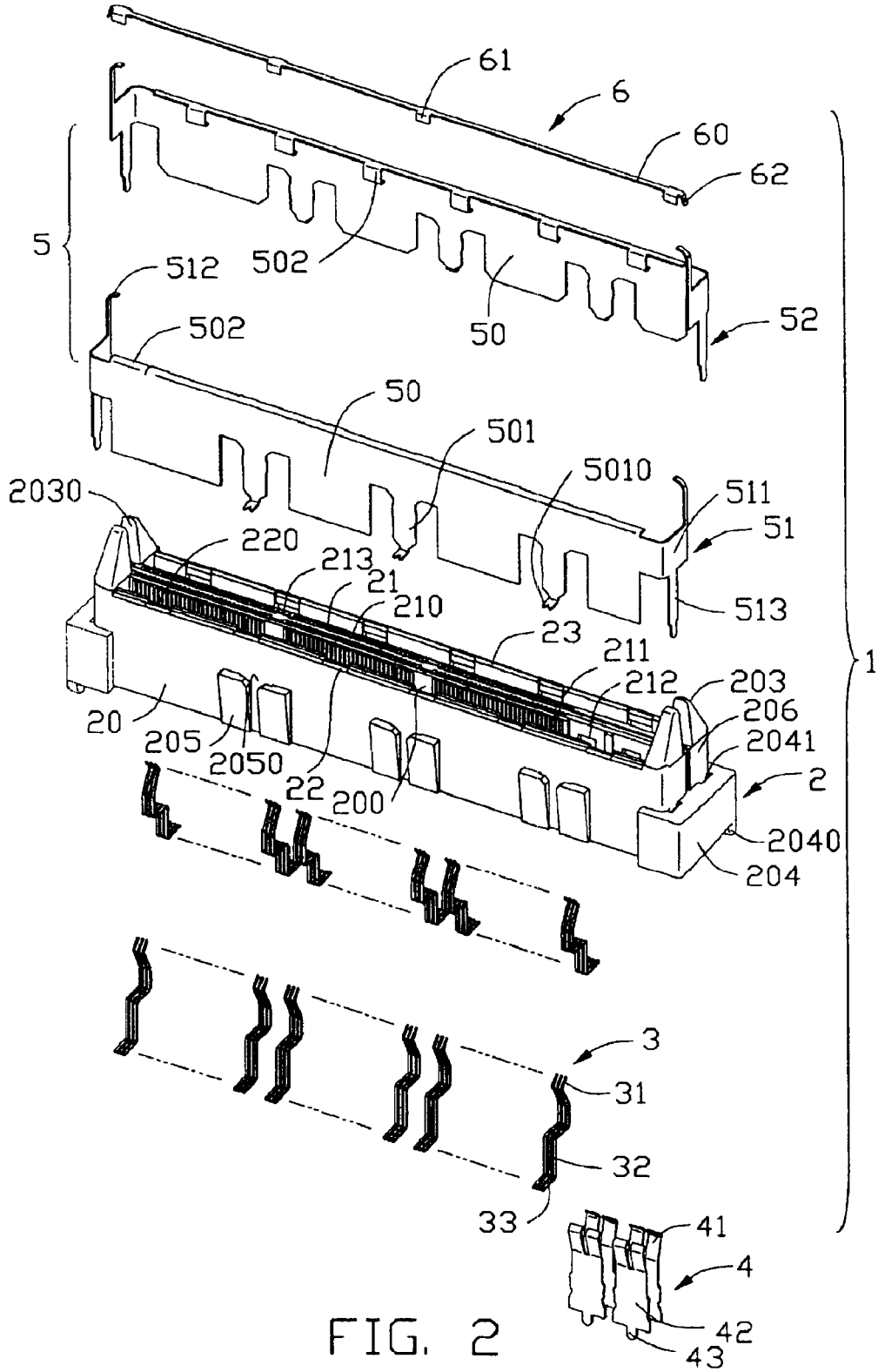
FIG. 2 is an exploded, perspective view of FIG. 1.

Referring to FIGS. 1 and 2, an electrical connector 1 in accordance with the present invention comprises an elongated insulative housing 2, a plurality of terminals comprising a plurality of signal contacts 3 and a plurality of power contacts 4, a conductive shielding shell enclosing the insulative housing 2 and a grounding strip 6.

The insulative housing 2 comprises a base portion 20 comprising a mating face 201, a mounting face 202 opposite to the mating face 201, opposite longitudinal walls 22, 23 connecting with the mating face 201 and the mounting face 202, and a pair of lateral walls 206. The longitudinal walls 22, 23 and the lateral walls 206 forms a shroud wall and define a receiving cavity 200 therebetween. A pair of cone-shaped guiding posts 203 extend upwardly from each lateral wall 206 and a gap 2030 is formed between the pair of guiding posts 203. A plurality of tubers 205 is formed on lower ends of the opposite longitudinal walls 22, 23. A retaining slot 2050 is formed between every adjacent two tubers 205. A plurality of extrusions 220 is formed on opposite inner sides of the opposite longitudinal walls 22, 23 and located adjacent to the mating face 201. A pair of flanges 204 are respectively formed with the pair of lateral walls 206 and extend longitudinally from the lateral walls 206. A positioning post 2040 extends downwardly from one corner of the flange 204. A pair of channels 2041 are formed between each flange 204 and the corresponding lateral wall 206. A tongue portion 21 extends upwardly from a bottom of the receiving cavity 200 and defines a plurality of passages 211, 212 on opposite surfaces thereof. An elongated receiving groove 210 is defined in a top surface of the tongue portion 21. A plurality of pairs of engaging grooves 213 are also defined in the top surface of the tongue portion 21 and each pair of engaging grooves 213 are located beside the receiving groove 210 symmetrically.

Each of the signal and the power contacts 3, 4 comprises a curved mating portion 31, 41, a retaining portion 32, 42 extending downwardly from the mating portion 31, 41 and a soldering portion 33, 43 extending vertically from the retaining portion 32, 42.

The shielding shell 5 comprises a first shell-half 51 and a second shell-half 52 having the same structure as that of the first shell-half 51. Each of the first and the second shell halves 51, 52 comprises a flat plate portion 50 and a pair of side portions 511 extending vertically from opposite ends of the plate portion 50. The plate portion 50 is partially cutoff to form a plurality of retaining sheets 501. Each retaining sheet 501 is formed with a vertical soldering pad 5010. A plurality of latches 502 bends downwardly from an upper edge of the plate portion 50. The side portion 511 is formed with a pin-shaped connecting portion 512 extending upwardly therefrom and a leg portion 513 extending downwardly therefrom with a soldering tip 521 at the distal end.

The grounding strip 6 comprises a bar portion 60, a plurality of pairs of claws 61 formed with the bar portion 60 and a pair of contacting portions 62 extending downwardly and outwardly from opposite ends of the bar portion 60.

Figure 3:
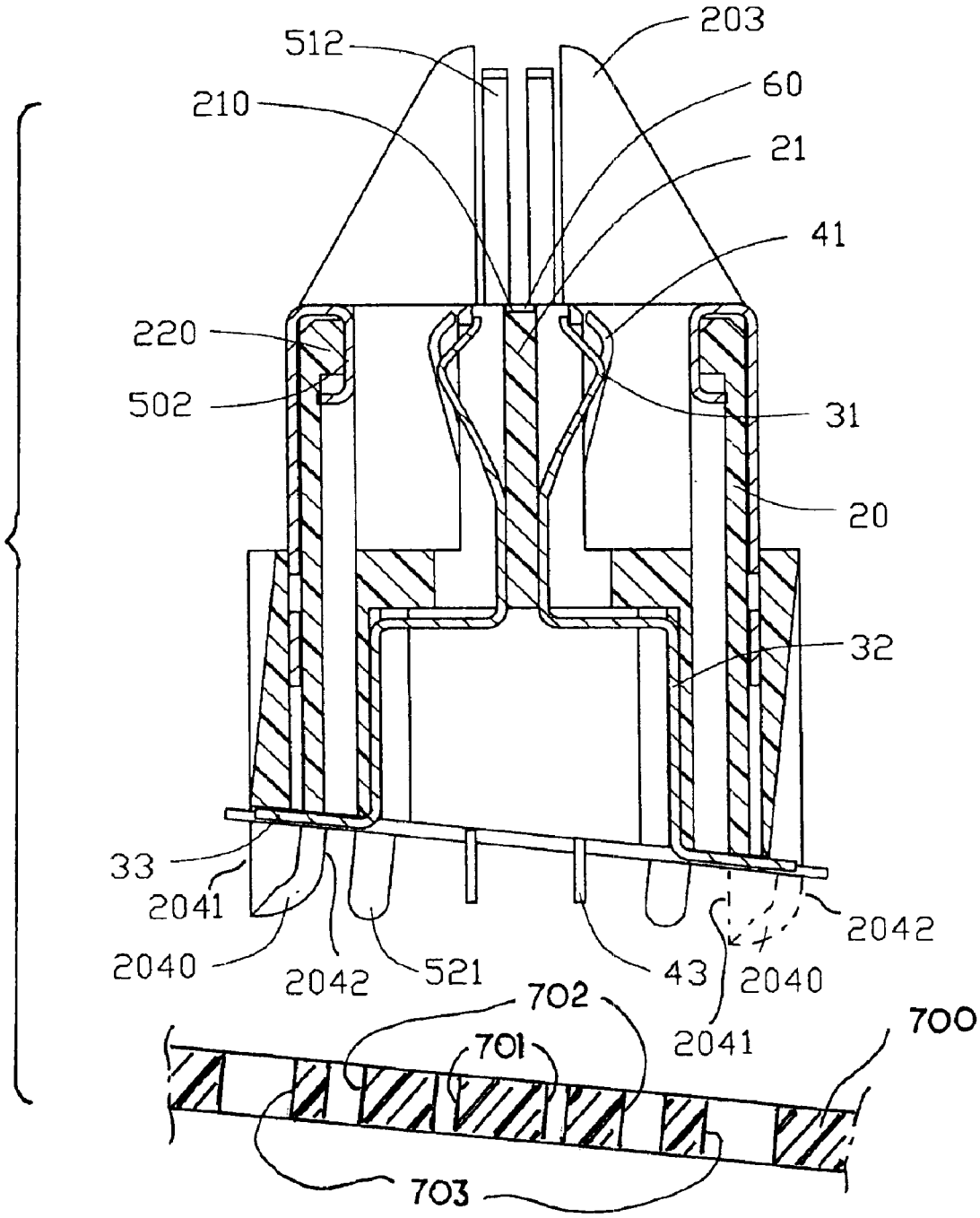
FIG. 3 is a cross-sectional view taken along line 3—3 of FIG. 1 with the associated printed circuit board wherein the cross-sectional view of the printed circuit board is not taken linearly but with some deflections for showing all the through holes therein at the same time even though such through holes are actually not all aligned in the cross-sectional plan.
Figure 4:
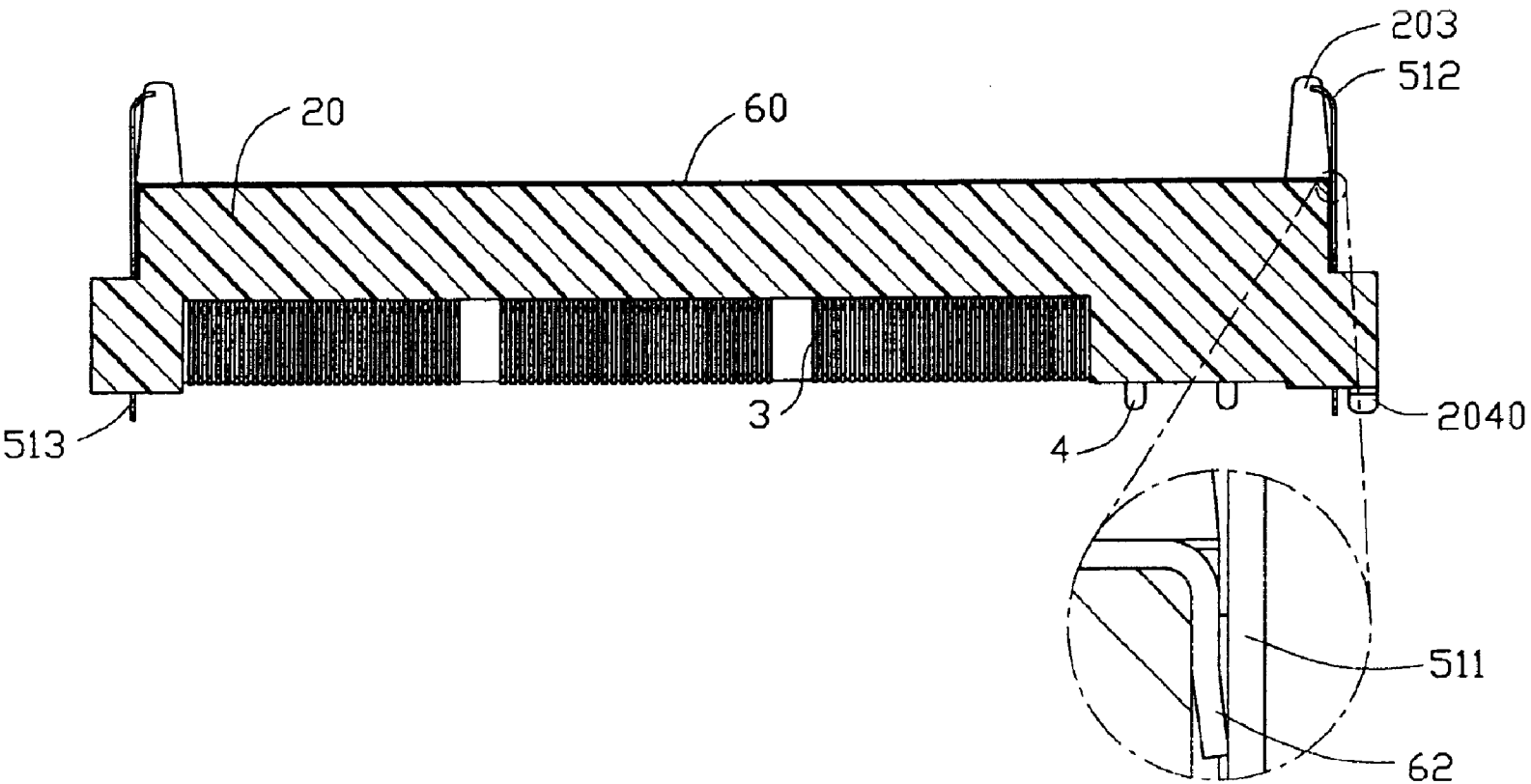
FIG. 4 is a cross-sectional view taken along line 4—4 of FIG. 1.

Referring to FIGS. 3 and 4, the signal and the power contacts 3, 4 are respectively inserted into the passages 211, 212 in a down-to-up direction. The bar portion of the grounding strip 6 is received in the receiving groove 210 of the tongue portion 21. The claws 61 are respectively received in the engaging grooves 213 for securing the grounding strip 6 to the insulative housing 2 reliably.

The pair of shell-halves 51, 52 are assembled to the insulative housing 2 in an up-to-down direction. The plate portions 50 of the shell-halves 51, 52 respectively enclose the pair of longitudinal walls 22, 23. The retaining sheets 501 are received in the retaining slots 2050 and the leg portions 513 are respectively engagingly received in the channels 2041. The latches 502 of the shell-halves 51, 52 respectively latch with the extrusions 220 and the connecting portions 512 are respectively received in the gaps 2030 for engaging with a complementary connector (not shown). The side portions 511 respectively enclose the lateral walls 206 of the insulative housing 2 and electrically connect with the contacting portions 62 of the grounding strip 6. Thus, the grounding strip 6 is grounded via the electrical connection between the shielding shell 5 and a grounding circuit of a printed circuit board 700. Even the mating face 201 of the electrical connector 1 is touched unintentionally, the electrostatic electricity can be discharged in time.

It is noted that the printed circuit board 700 defines the first through holes 701 to receive the corresponding soldering portions 43, the second through holes 702 to receive the corresponding soldering tip 521, and third through holes 703 to receive the corresponding positioning posts 2040. It can be noted that because the soldering tip 521 is stamped from a metal sheet and located in a transverse plane where the obliqueness occurs, the soldering tip 521 can extend in an oblique manner to comply with the oblique printed circuit board 700. Thus, the soldering portion 521 and the corresponding through hole 702 are essentially engaged with each other in a perpendicular manner. Differently, the soldering portion 43 located in a lengthwise plane, cannot comply with the oblique printed circuit board 700 unless the solder portion 43 is intentionally bent to comply therewith. Anyhow, sometimes bending the solder portion 43 to comply with the corresponding through hole 701 results in uncontrollable inaccuracies. Therefore, in the instant invention the vertical soldering portion 43 without further bending is received in the corresponding through hole 701 in an oblique manner rather than the perpendicular manner. As to the positioning post 2040, because the positioning post 2040 is integrally formed with the housing 2 which is generally requisitely made via injection molding, only one side 2042 thereof which faces the long side of the housing 2 can be formed in an oblique manner, similar to the soldering tip 521, to comply with the oblique printed circuit board 700 for molding consideration, while the opposite side 2041 facing the short side can only be formed in a vertical manner, similar to the soldering portion 43. In other words, in the instant invention, the positioning post 2040 is a hybrid type in comparison with the pure vertical type soldering portion 43 and the pure oblique type soldering tip 521.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing comprising a shroud wall defining a receiving cavity and a tongue portion extending into the receiving cavity, the shroud wall comprising a pair of longitudinal walls and a pair of lateral walls, the tongue portion defining a plurality of passages in opposite sides thereof, a receiving groove in a top surface thereof and a plurality of engaging grooves located beside the receiving groove symmetrically;

a plurality of terminals respectively received in the passages of said tongue portion;

a conductive shielding shell enclosing the insulative housing and comprising a first shell-half and a second shell-half, each of the first and the second shell-halves comprising a plate portion endosing the longitudinal wall and a side portion vertically extending from the plate portion and enclosing the lateral wall; and a grounding strip comprising a bar portion received in said receiving groove, a plurality of claws respectively engagingly received in said engaging grooves and a pair of contacting portions formed at opposite ends of the bar portion and electrically contacting with the side portions of the first and the second shell-halves for being grounded;

wherein the terminals comprise a plurality of signal contacts and a plurality of power contacts, wherein the side portion of the shielding shell forms a connection portion, and wherein the insulative housing forms a pair of guiding posts extending upwardly from each lateral wall, the pair of guiding posts forming a gap therebetween to receive the connection portion of the;

wherein the plate portion of each of the first and the second shell-halves forms a plurality of retaining sheets, and wherein the insulative housing forms a plurality of tubers, the retaining sheets being respectively received between every two adjacent tubers;

wherein each retaining sheet is formed with a soldering pad adapted for being soldered to a printed circuit board;

wherein each of the first and the second shell-halves forms a plurality of latches, and wherein the insulative housing forms a plurality of extrusions on opposite longitudinal walls respectively engaging with said latches.

2. The electrical connector as claimed in claim 1, wherein the insulative housing forms a pair of flanges integrally extending from the lateral walls, each flange and the corresponding lateral wall together forming a pair of channels, and wherein each side portion of the first and the second shell-halves forms a leg portion received in the channel.

3. An electrical connector assembly comprising:

an electrical connector including:

an elongated insulative housing extending along a lengthwise direction and defining a mating face and a mounted face opposite to said mating face in an oblique manner so as to form a long side and a short side along a transverse direction perpendicular to said lengthwise direction;

a plurality of passageways extending in said housing in a vertical direction perpendicular to said mating face and to both said lengthwise and transverse directions;

a metallic piece disposed in the housing, said metallic piece stamped from a metal sheet and extending in a transverse plane perpendicular to said lengthwise direction, a printed circuit board obliquely positioned under the housing and in a parallel relation with the mounting face;

a plurality of through holes perpendicularly extending through the printed circuit board and with a perpendicular relation with regard to the mounting face; wherein said metallic piece includes a soldering tip which is coplanar with a main body of the metallic piece without bending, and said soldering tip extends downwardly perpendicular to said mounting face and through the corresponding through holes in an alignment manner;

further including another metallic niece disposed in the housing, said another metallic piece extends in a lengthwise plane perpendicular to said transverse direction, wherein said another metallic piece includes a solder portion which is coplanar with a main body of said another metallic piece without bending, and said solder portion extends downwardly perpendicular to the mating face while oblique to the mounting face, and wherein said solder portion extends through the corresponding through hole obliquely;

further including a positioning post integrally downwardly extending from the mounting face of the housing and through the corresponding through hole, wherein said positioning post defines a vertical side perpendicular to the mating face while oblique to the corresponding through hole, and an oblique side perpendicular to the mounting face and aligned with the through hole.

* * * * *